US008869536B2

(12) United States Patent
Clifford et al.

(10) Patent No.: US 8,869,536 B2
(45) Date of Patent: Oct. 28, 2014

(54) LINER STOP FOR TURBINE SYSTEM COMBUSTOR

(75) Inventors: Robert Wade Clifford, Duncan, SC (US); Jonathan Hale Kegley, Greer, SC (US)

(73) Assignee: General Electric Company, Schenectady, NY (US)

( * ) Notice: Subject to any disclaimer, the term of this patent is extended or adjusted under 35 U.S.C. 154(b) by 181 days.

(21) Appl. No.: 13/558,470

(22) Filed: Jul. 26, 2012

(65) Prior Publication Data

US 2014/0026581 A1 Jan. 30, 2014

(51) Int. Cl.
*F02C 1/00* (2006.01)
*F02C 7/20* (2006.01)

(52) U.S. Cl.
USPC ..... 60/752; 60/796; 60/797; 60/798

(58) Field of Classification Search
USPC ..... 60/752, 760, 796–798, 39.31, 39.32
See application file for complete search history.

(56) References Cited

U.S. PATENT DOCUMENTS

| | | | | |
|---|---|---|---|---|
| 5,323,600 | A * | 6/1994 | Munshi | 60/772 |
| 5,749,218 | A * | 5/1998 | Cromer et al. | 60/796 |
| 6,216,442 | B1 * | 4/2001 | Belsom et al. | 60/797 |
| 6,279,313 | B1 * | 8/2001 | Lawen et al. | 60/797 |
| 7,762,075 | B2 | 7/2010 | Pangle et al. | |
| 2009/0044540 | A1 * | 2/2009 | Pangle et al. | 60/752 |
| 2010/0151272 | A1 * | 6/2010 | Nardi | 428/627 |
| 2011/0314829 | A1 * | 12/2011 | Kuppusamy | 60/752 |
| 2012/0036857 | A1 * | 2/2012 | Bassani | 60/752 |
| 2012/0297782 | A1 * | 11/2012 | Cihlar et al. | 60/772 |

* cited by examiner

*Primary Examiner* — Gerald Luther Sung
*Assistant Examiner* — Scott Walthour
(74) *Attorney, Agent, or Firm* — Dority & Manning, P.A.

(57) ABSTRACT

A liner stop for retaining a flow sleeve relative to a combustion liner in a combustor is disclosed. The liner stop includes a female component defining a recess and a male component comprising a protrusion, the protrusion insertable in the female component. The liner stop further includes an insert disposable between the female component and the male component, the insert comprising a surface protrusion configured to interfere with one of the female component or the male component.

18 Claims, 4 Drawing Sheets

LINER STOP FOR TURBINE SYSTEM COMBUSTOR

FIELD OF THE INVENTION

The present disclosure relates in general to turbine systems and more particularly to apparatus for retaining flow sleeves relative to combustion liners in combustors of gas turbines.

BACKGROUND OF THE INVENTION

Turbine systems are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

In the combustor section of many typical turbine systems, each combustor includes a combustion liner. The combustion liner is a generally annular tube through which the combusted hot gas flows. A flow sleeve may generally surround the combustion liner. Cooling fluid may be allowed to flow between the flow sleeve and combustion liner to, for example, cool the combustion liner.

In many cases, it is desirable to retain the flow sleeve relative to the combustion liner. Retention of the flow sleeve allows cooling fluid to generally consistently flow between the flow sleeve and combustion liner by generally maintaining the spacing between the flow sleeve and combustion liner. One example of apparatus for retaining a flow sleeve is provided in U.S. Pat. No. 7,762,075 to Pangle et al., which discloses a combustion liner stop in a gas turbine. The stop includes a male component, a female component, and an insert. The insert is attached to the male component, such as by welds.

The liner stop of Pangle et al. is suitable for retaining flow sleeves relative to combustion liners. However, in the event of component wear, field replacement of the various components of these liner stops requires labor intensive activities, such as welding and/or grinding. Further, the inserts, such as the welds thereof, can detach, causing the inserts to separate from the male components during inspection. In these cases, the inserts must be replaced, which may require on-site welding. Such replacement procedures can thus be cumbersome, time consuming, and expensive.

Accordingly, an improved liner stop for a turbine system combustor is desired in the art. For example, a liner stop that suitably retains a flow sleeve with respect to a combustion liner, without requiring attachment of various components of the liner stop, such as inserts thereof, to each other would be advantageous.

BRIEF DESCRIPTION OF THE INVENTION

Aspects and advantages of the invention will be set forth in part in the following description, or may be obvious from the description, or may be learned through practice of the invention.

In one embodiment, the present disclosure is directed to a liner stop for retaining a flow sleeve relative to a combustion liner in a combustor. The liner stop includes a female component defining a recess and a male component comprising a protrusion, the protrusion insertable in the female component. The liner stop further includes an insert disposable between the female component and the male component, the insert comprising a surface protrusion configured to interfere with one of the female component or the male component.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
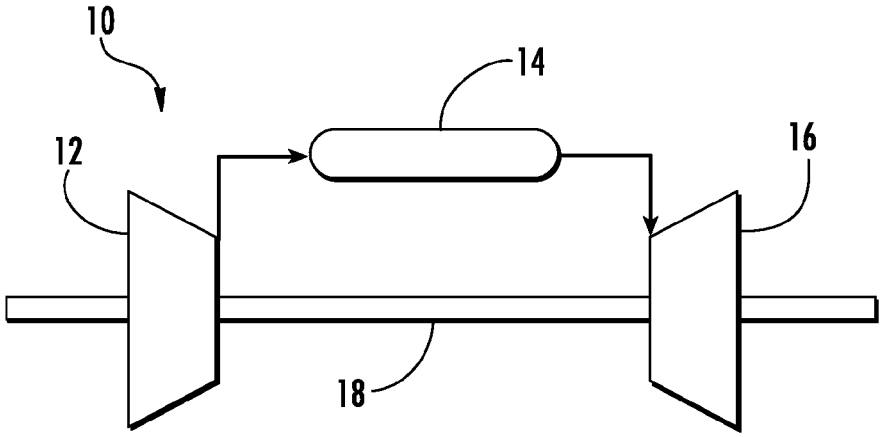
FIG. 1 is a schematic view of a gas turbine system according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. It should be understood that the turbine system 10 of the present disclosure need not be a gas turbine system 10, but rather may be any suitable turbine system 10, such as a steam turbine system or other suitable system. The gas turbine system 10 may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator or other suitable energy storage device, or may be connected directly to, for example, an electrical grid. Exhaust gases from the system 10 may be exhausted into the atmosphere, flowed to a steam turbine or other suitable system, or recycled through a heat recovery steam generator.

Figure 2:
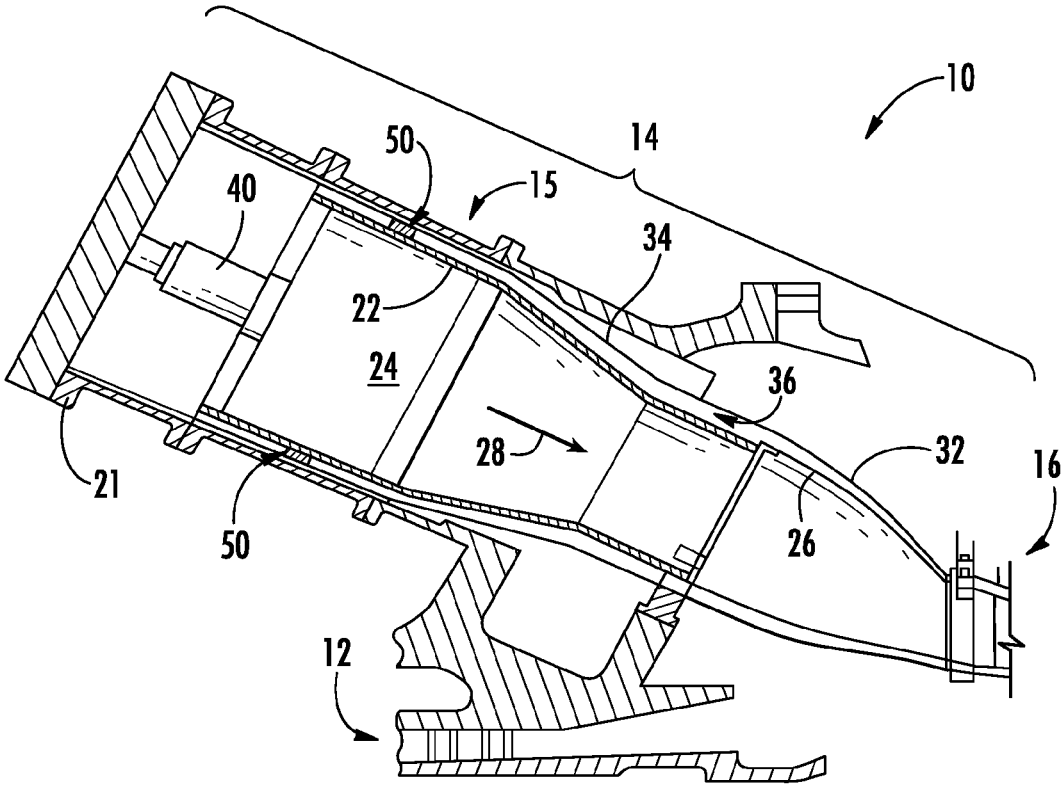
FIG. 2 is a cross-sectional view of several portions of a gas turbine system according to one embodiment of the present disclosure.
Figure 3:
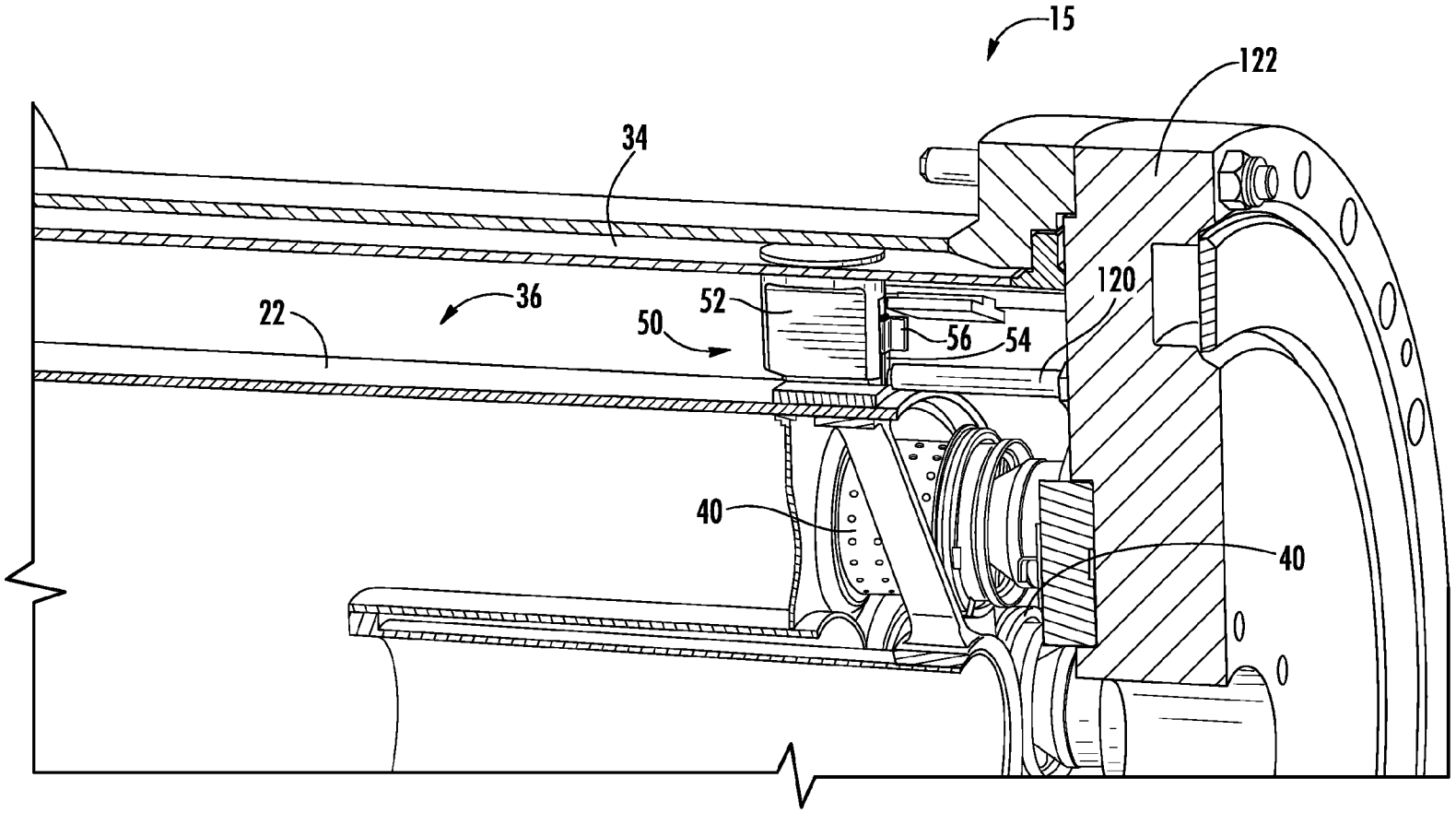
FIG. 3 is a sectional side perspective view of a combustor according to one embodiment of the present disclosure.
Figure 4:
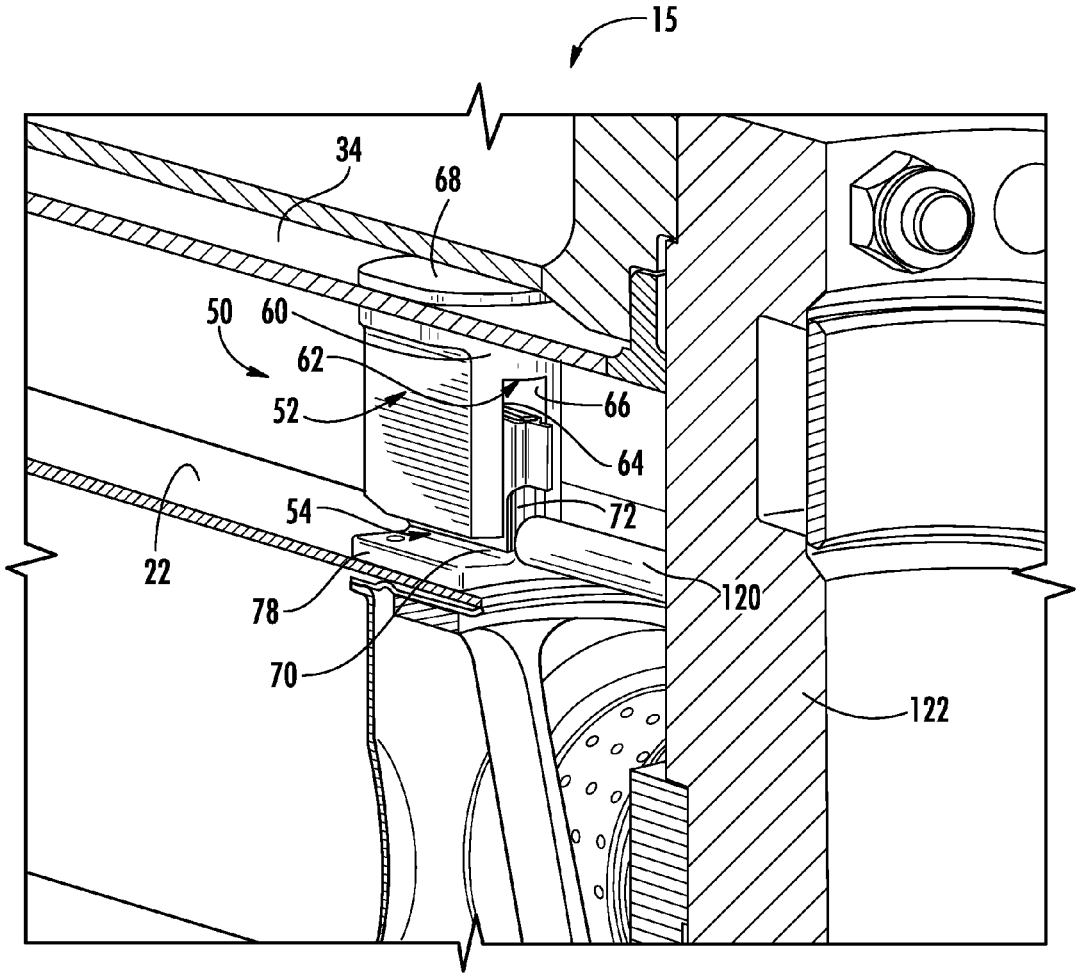
FIG. 4 is a sectional rear perspective view of a combustor according to one embodiment of the present disclosure.
Figure 5:
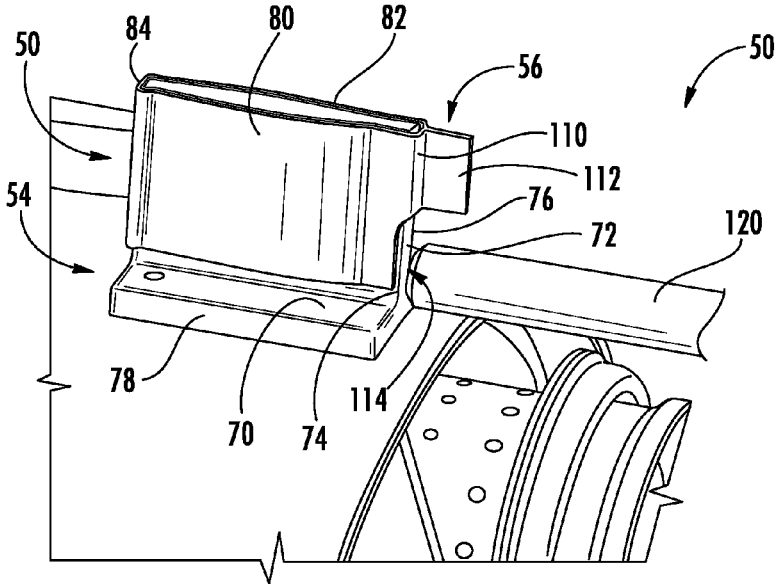
FIG. 5 is a perspective view of a combustion liner, various components of a liner stop, and an end cover pin according to one embodiment of the present disclosure.
Figure 6:
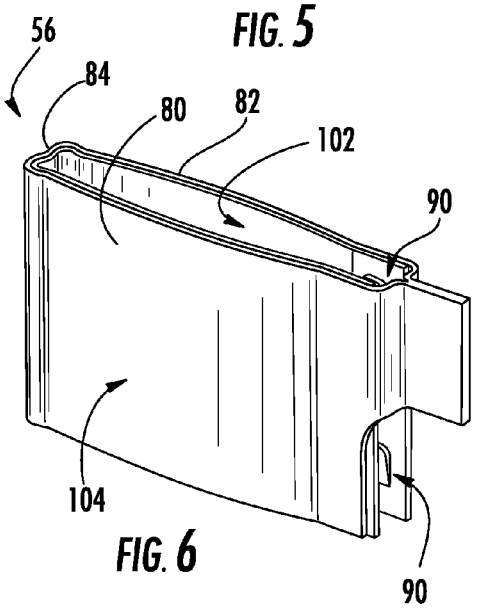
FIG. 6 is a perspective view of an insert according to one embodiment of the present disclosure.

Referring to FIG. 2, a simplified drawing of several portions of a gas turbine system 10 is illustrated. The gas turbine system 10 as shown in FIG. 2 comprises a compressor section 12 for pressurizing a working fluid that is flowing through the system 10. The working fluid is typically air, but may be any suitable liquid or gas. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves may be at least partially disposed in the casing 21. For example, a combustor liner 22 may generally define a combustion zone 24 therein. Combustion of the working fluid, fuel, and optional oxidizer may generally occur in the combustion zone 24. The resulting hot gases of combustion may flow downstream in direction 28 through the combustion liner 22, and in some embodiments into a transition piece 26 which further defines the combustion zone, and then flow into the turbine section 16.

An impingement sleeve 32 and flow sleeve 34 may generally circumferentially surround combustor liner 22 and transition piece 26, as shown. A flow passage 36 surrounding the combustor liner 22 and transition piece 26, through which working fluid may flow in an upstream direction, may thus further be defined be the impingement sleeve 32 and flow sleeve 34. Thus, the flow passage 36 may be defined between the sleeve comprising the impingement sleeve 32 and flow sleeve 34 and the sleeve comprising the combustor liner 22 and transition piece 26. As such, the working fluid flows through the flow passage 36 in the upstream direction, enters the combustor 15 and is combusted with the fuel as discussed, and the resulting hot gas flows through the combustion zone 24 in the downstream direction 28.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

In many cases, the flow sleeve 34 must be retained relative to the combustion liner 22 in one or more directions, such as in exemplary embodiment the radial direction. Such retention may generally maintain the size and shape of the flow passage 36 during operation, by preventing shifting of the flow sleeve 34 in the radial direction causing portions of the flow passage 36 to increase and/or decrease in size.

Thus, liner stops 50 are disclosed. Each liner stop 50 according to the present disclosure may retain a flow sleeve 34 relative to a combustion liner 22, as discussed above. Exemplary liners stops 50 and components thereof according to the present disclosure are shown in FIGS. 2 through 7.

A liner stop 50 according to the present disclosure includes a female component 52, a male component 54, and an insert 56. The female component 52 includes a body 60 that defines a recess 62 (also termed a "cutout" or "saddle") therein. Opposing sidewalls 64, 66 may be defined by the recess 62, the planes of which in some embodiments may be generally parallel. The female component 52 may further include a base 68, as shown.

The male component 54 includes a body 70 that includes a protrusion 72. The protrusion 72 may be shaped and sized to be insertable in the female component 52, such as between the sidewalls 64, 66, and may thus mate with the female component 52. For example, opposing sidewalls 74, 76 may define the protrusion 72, the planes of which in some embodiments may be generally parallel. The male component 54 may further include a base 78, as shown.

It should be understood that the male component 54 and female component 52 of a liner stop 50 according to the present disclosure may have any suitable shape and size. For example, the recess 62 and mating protrusion 72 may have any suitable shape and size, including any suitable number of planer or curviplaner sidewalls.

The female component 52 of a liner stop 50 according to the present disclosure is fastenable to either the flow sleeve 34 or the combustion liner 22, and the male component 54 of that liner stop 50 is fastenable to the other of the flow sleeve 34 or the combustion liner 22. The base 68 or 78 of the female component 52 or male component 54, or any other suitable component thereof, may be fastened to the flow sleeve 34 or combustion liner 22. In exemplary embodiments as shown, the male component 54 is fastenable to the combustion liner 22 and the female component 52 is fastenable to the flow sleeve 34. Any suitable fastening apparatus or process may be utilized to fasten the female component 52 and male component 54 to the flow sleeve 34 and combustion liner 22. For example, suitable mechanical fasteners, such as nut-bolt combinations, nails, screws, rivets, etc., may be utilized, or the female component 52 and/or male component 54 may be welded to the combustion liner 22 or flow sleeve 34. Alternatively, the female component 52 and/or male component 54 may be integral with the combustion liner 22 or flow sleeve 34.

An insert 56 according to the present disclosure is disposable between a mating female component 52 and male component 54. As shown, the insert 56 may include, for example, a first sidewall 80 and a second opposing sidewall 82. The first sidewall 80 may have a suitable shape and size to fit between, for example, sidewalls 64 and 74, while the opposing sidewall 82 may have a suitable shape and size to fit between, for example, sidewalls 66 and 74. The sidewalls 80, 82 may in exemplary embodiments be spring walls, such as leaf springs, or alternatively may have any other suitable shape and size. An end wall 84 may connect the sidewalls 80, 82 as shown.

An insert 56 according to the present disclosure further includes one or more surface protrusions 90. Each surface protrusion protrudes from the insert 50, such as from a sidewall 80, 82 or other component thereof, and in exemplary embodiments is typically a protruding portion of the insert 50 or component thereof. Further, each surface protrusion 90 is configured to interfere with one of the female component 52 or the male component 54. For example, when the insert 50 is disposed between the female component 52 and the male component 54, such that the sidewalls 80 are between the respective sidewalls 64, 74 and 66, 76, a surface protrusion 90 according to the present disclosure may contact the female component 52 or male component 54, such as a sidewall 64, 66, 74, 76 thereof, creating an interference fit between the insert 50 and that component. A surface protrusion 90 may protrude from a sidewall 80, 82, an end wall 84, or any other suitable component of the insert 50.

In exemplary embodiments as shown, for example, a surface protrusion 90 is configured to interfere with the male component 54. Thus, when the insert 50 is disposed between the female component 52 and the male component 54, a surface protrusion 90 may, for example, contact a sidewall 74 or 76 and thus interfere with the male component 54. In other embodiments, however, a surface protrusion 90 is configured to interfere with the female component 54.

In some embodiments, as shown, a surface protrusion 90 according to the present disclosure is a louver. The louver may, for example, be partially punched out from the insert 56, such as from a sidewall 80, 82 or other component thereof. In other embodiments, a surface protrusion 90 may be, for example, a dimple. The dimple may be pressed out from the insert 56, such as from a sidewall 80, 82 or other component thereof. In other embodiments, a surface protrusion 90 may be any suitable protruding component or portion of an insert 50 that interferes with a female component 52 or male component 54, as discussed.

In some embodiments, an insert 56 according to the present disclosure includes a single layer. In other embodiments, an insert 56 according to the present disclosure, such as the various components thereof, may include two or more layers. For example, as shown, an insert 56 according to some embodiments may include an inner sleeve 102 and an outer sleeve 104. Thus, as shown, each sidewall 80, 82 and the end wall 84 may include two layers. One or both layers may include surface features 90. For example, in exemplary embodiments as shown, the inner sleeve 102 includes surface protrusions 90 protruding therefrom, which interfere with the male component 54. Additionally or alternatively, for example, the outer sleeve 102 may include surface protrusions 90 protruding therefrom, which interfere with the female component 52.

Further, in some embodiments the insert 56 or a component thereof may include a wear coating. A wear coating is generally a surface coating that protects a component from wear due to, for example, contact with other components, etc. One suitable type of wear coating is a high velocity oxygen fuel coating, which may be applied for example through high velocity oxygen fuel spraying. Any suitable liquid or gas fuel, such as hydrogen, methane, propane, propylene, acetylene, natural gas, or kerosene, may be utilized. Further, any suitable powder, such as WC—Co, chromium carbide, MCrAlY, or alumina, or any other suitable ceramic or metallic powder, may be applied through a high velocity oxygen fuel coating. However, wear coatings according to the present disclosure are not limited to high velocity oxygen fuel coatings. Rather, any suitable wear coating is within the scope and spirit of the present disclosure.

In some embodiments, a wear coating may be applied, for example, to the outer sleeve 104 or any component thereof. Additionally or alternatively, a wear coating may be applied to the inner sleeve 102 or any component thereof, or to any suitable component of the insert 56.

Figure 7:
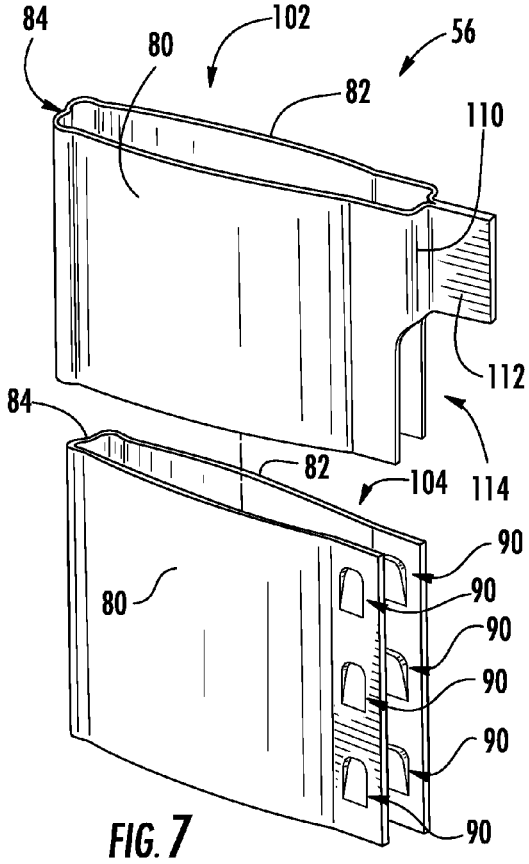
FIG. 7 is a perspective exploded view of an insert according to one embodiment of the present disclosure.

As discussed, an insert 56 according to the present disclosure may in some embodiments include opposing sidewalls 80, 82 and an end wall 84 connecting the sidewalls 80, 82. In some embodiments, the ends of the sidewalls 80, 82 not connected by the end wall 84 may be free, and thus not connected together. In some of these embodiments, the insert 56 or a component thereof may thus have a generally U-shaped cross-sectional profile. For example, as shown in FIG. 7, in embodiments wherein the insert 56 includes two layers, the inner sleeve 102 may have a generally U-shaped cross-sectional profile. Additionally or alternatively, the outer sleeve 104 may have a generally U-shaped cross-sectional profile.

Additionally or alternatively, the ends of the sidewalls 80, 82 not connected by the end wall 84 may be connected, such as by, for example, an opposing sidewall 110, which may include a tab 112 extending therefrom as shown. In some of these embodiments, the insert 56 or a component thereof may thus have a generally continuous cross-sectional profile. For example, as shown in FIG. 7, in embodiments wherein the insert 56 includes two layers, the outer sleeve 104 may have a generally continuous cross-sectional profile. Additionally or alternatively, the inner sleeve 102 may have a generally continuous cross-sectional profile.

In some embodiments, such as wherein the insert 56 or a component thereof is generally continuous, a cutout portion 114 may be defined in the insert 56. For example, a cutout portion 114 may be defined in the outer sleeve 104 of the insert 56, such in the sidewall 110 or any other suitable location. The cutout portion 114 may be defined in the insert and configured to receive an end cover pin 120 therein. The end cover pin 120 may extend from an end cover 122 of a combustor 15 into the flow passage 36. In embodiments wherein the insert 56 is positioned such that the end cover pin 120 may, for example, contact the insert 56, the cutout portion 114 may be defined to receive and thus accommodate the end cover pin 120. The cutout portion 114 may be shaped and sized to allow the end cover pin 120 to be received therein.

The insert 56, such as any component thereof, may be formed from any suitable materials. In exemplary embodiments, metals, metal alloys, or metal superalloys may be utilized. Cobalt superalloys, nickel superalloys, iron superalloys, stainless steel, and carbon steel are examples of suitable materials.

Liner stops 50 according to the present disclosure advantageously retain flow sleeves 34 relative to combustion liners 22, and may further advantageously provide damping properties due to the use of inserts 56 having spring components. Further, as discussed, inserts 56 according to the present disclosure do not require attachment to the male component 54 or female component 52 of the liner stops 50. Rather, surface protrusions 90 advantageously provide suitable retention of the inserts 90 between the female components 52 and male components 54 due to interference therewith, without the need for attachment. Thus, insert 56 repair and replacement is relatively easy, efficient and inexpensive.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A liner stop for retaining a flow sleeve relative to a combustion liner in a combustor, the liner stop comprising;

a female component defining a recess;

a male component comprising a protrusion, the protrusion insertable in the female component, wherein the male component is fastened to the combustion liner; and an insert disposable between the female component and the male component, the insert comprising a first sidewall and a second opposing sidewall, one of the first sidewall or the second sidewall comprising a flat surface, the flat surface defining a portion of the recess when the insert is disposed between the female and male component, and a surface protrusion protruding from the flat surface of the one of the first sidewall or the second sidewall towards the other of the first sidewall or the second sidewall, the surface protrusion configured to frictionally interfere with the male component.

2. The liner stop of claim 1, wherein the insert comprises a plurality of surface protrusions.

3. The liner stop of claim 1, wherein the surface protrusion is a louver.

4. The liner stop of claim 1, wherein the insert comprises an inner sleeve and an outer sleeve, and wherein the inner sleeve comprises the surface protrusion.

5. The liner stop of claim 4, further comprising a wear coating applied to the outer sleeve.

6. The liner stop of claim 5, wherein the wear coating is a high velocity oxygen fuel coating.

7. The liner stop of claim 4, wherein the outer sleeve has a generally continuous cross-sectional profile.

8. The liner stop of claim 4, wherein the inner sleeve has a generally shaped cross-sectional profile.

9. The liner stop of claim 1, wherein the insert defines a cutout portion.

10. The liner stop of claim 1, wherein the insert comprises one of a metal, metal alloy, or metal superalloy.

11. The liner stop of claim 1, wherein the female component is fastenable to the flow sleeve and the male component is fastenable to the combustion liner.

12. A combustor for a turbine system, the combustor comprising:

a combustion liner;

a flow sleeve generally surrounding the combustion liner;

a liner stop retaining the flow sleeve relative to the combustion liner, the liner stop comprising:

a female component fastened to the flow sleeve and defining a recess;

a male component fastened to the combustion liner and comprising a protrusion, the protrusion inserted in the female component; and an insert disposed between the female component and the male component, the insert comprising a first sidewall and a second opposing sidewall, one of the first sidewall or the second sidewall comprising a flat surface, the flat surface defining a portion of the recess when the insert is disposed between the female and male component, and a surface protrusion protruding from the flat surface of the one of the first sidewall or the second sidewall towards the other of the first sidewall or the second sidewall, the surface protrusion frictionally interfering with the male component.

13. The combustor of claim 12, wherein the insert comprises a plurality of surface protrusions.

14. The combustor of claim 12, wherein the surface protrusion is a louver.

15. The combustor of claim 12, wherein the insert comprises an inner sleeve and an outer sleeve, and wherein the inner sleeve comprises the surface protrusion.

16. The combustor of claim 15, further comprising a wear coating applied to the outer sleeve.

17. The combustor of claim 12, further comprising an end cover pin, and wherein the insert defines a cutout portion configured to receive the end cover pin.

18. The combustor of claim 12, further comprising a plurality of inserts.

* * * * *

UNITED STATES PATENT AND TRADEMARK OFFICE

CERTIFICATE OF CORRECTION

PATENT NO. : 8,869,536 B2
APPLICATION NO. : 13/558470
DATED : October 28, 2014
INVENTOR(S) : Robert Wade Clifford et al.

It is certified that error appears in the above-identified patent and that said Letters Patent is hereby corrected as shown below:

In The Claims

Column 7, line 17: "shaped" should read "U-shaped"

Signed and Sealed this
Third Day of May, 2016

Michelle K. Lee

Michelle K. Lee
*Director of the United States Patent and Trademark Office*